United States Patent [19]

Koch

[11] 4,234,091

[45] Nov. 18, 1980

[54] NESTED CONTAINER AND BASE CONNECTION

[75] Inventor: Roderic M. Koch, Evansville, Ind.

[73] Assignee: George Koch Sons, Inc., Evansville, Ind.

[21] Appl. No.: 949,458

[22] Filed: Oct. 10, 1978

[51] Int. Cl.[3] ..... B65D 21/02; A01G 9/02

[52] U.S. Cl. ..... 206/499; 47/66; 206/520; 220/23.86; 220/69

[58] Field of Search ..... 220/68, 69, 23.83, 23.86; 248/359, 146, 152, 154; 47/66, 71; 206/501, 502, 482, 518, 520, 499; 46/32

[56] References Cited

U.S. PATENT DOCUMENTS

| | | | |
|---|---|---|---|
| 1,093,033 | 4/1914 | Canby | 248/152 X |
| 1,778,175 | 10/1930 | Thune | 47/71 X |
| 2,059,813 | 11/1936 | Schellenger | 248/27.1 X |
| 2,201,611 | 5/1940 | Delcamp | 248/27.1 X |
| 2,210,283 | 8/1940 | Cowan | 206/502 |
| 2,244,984 | 6/1941 | Davis | 206/482 X |
| 2,301,216 | 11/1942 | Koontz | 46/32 X |
| 2,504,031 | 4/1950 | Manning | 47/71 |
| 2,656,163 | 10/1953 | Schwarz | 220/69 |
| 3,025,948 | 3/1962 | Appelt | 206/518 X |
| 3,528,584 | 9/1970 | Piccirilli | 47/71 X |
| 3,583,384 | 6/1971 | Ranisate | 220/69 X |
| 3,612,343 | 10/1971 | Phipps | 220/69 |
| 3,727,782 | 4/1973 | Doughty | 220/69 X |
| 3,933,246 | 1/1976 | Fulton | 206/520 |
| 3,965,616 | 6/1976 | Ridgeway | 220/69 X |

FOREIGN PATENT DOCUMENTS

| | | | |
|---|---|---|---|
| 108099 | 8/1943 | Sweden | 47/71 |
| 433499 | 8/1935 | United Kingdom | 206/502 |

*Primary Examiner*—Allan N. Shoap

*Attorney, Agent, or Firm*—Jenkins, Coffey, Hyland, Badger and Conard

[57] ABSTRACT

A container, a base, and a structure for connecting the base to the container. The containers are constructed to be nested together and shipped separately from their bases which can also be nested together. Each base is provided with a plurality of apertures or slots, and the bottom of each container is provided with tabs to be inserted through the apertures or slots in the base and bent over or twisted.

3 Claims, 8 Drawing Figures

NESTED CONTAINER AND BASE CONNECTION

The present invention relates to containers which may be nested together and shipped separately from their bases and quickly and easily attached to their bases at the point of use.

The present invention is particularly suitable for use in shipping floral baskets and floral containers which necessarily need a rather large and securely attached base. If the base is attached to the container in the factory, the shipment of the containers is made difficult and expensive because they will not nest.

An object of the present invention, therefore, is to provide means for quickly and easily and securely attaching a base to a container in the floral shop. In accordance with the present invention, each base is provided with a plurality of apertures or slots, and each container is provided with a plurality of tabs or protrusions insertable through the apertures or slots. The tabs or protrusions are bent or otherwise deformed to make the firm attachment between the container and base. For instance, the base may be provided with a plurality of slots and the container may be provided with a plurality of tabs insertable through the slots to be bent over or twisted.

Other objects and features of the present invention wlll become apparent as this description progresses.

Figure 1:
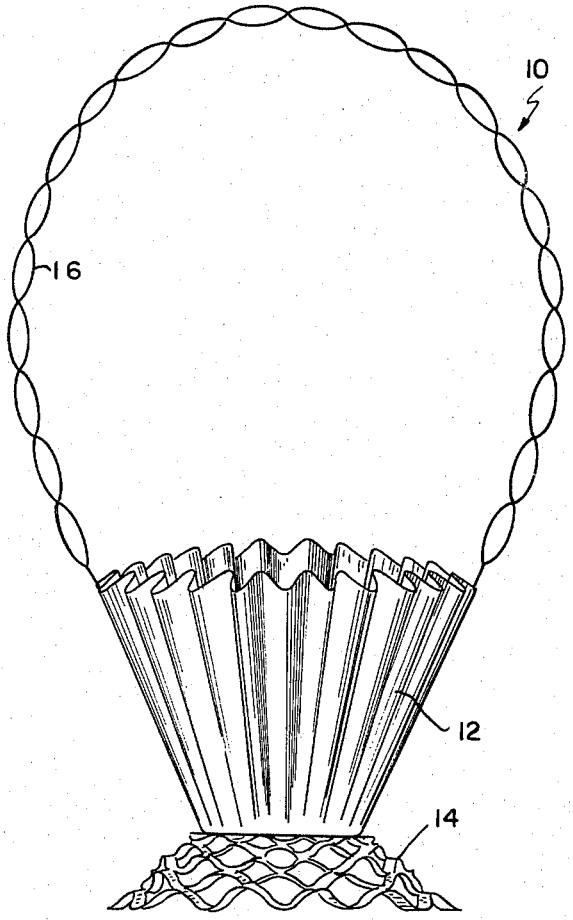
FIG. 1 is a front elevational view of a floral basket and its base.
Figure 3:
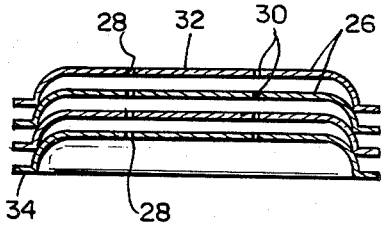
FIG. 3 is a sectional view of a plurality of relatively flat bases nested together.
Figure 2:
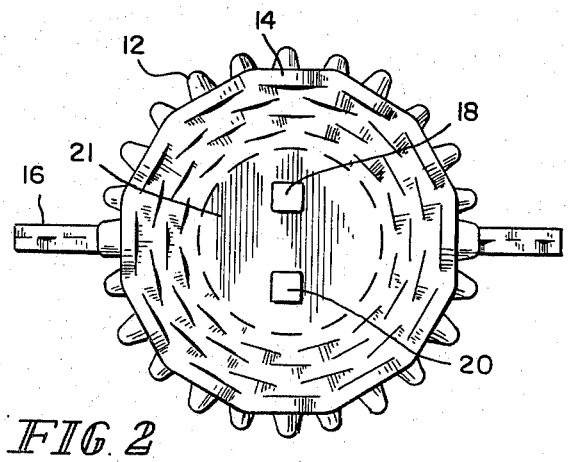
FIG. 2 is a bottom view of the floral basket and base of FIG. 1.
Figure 4:
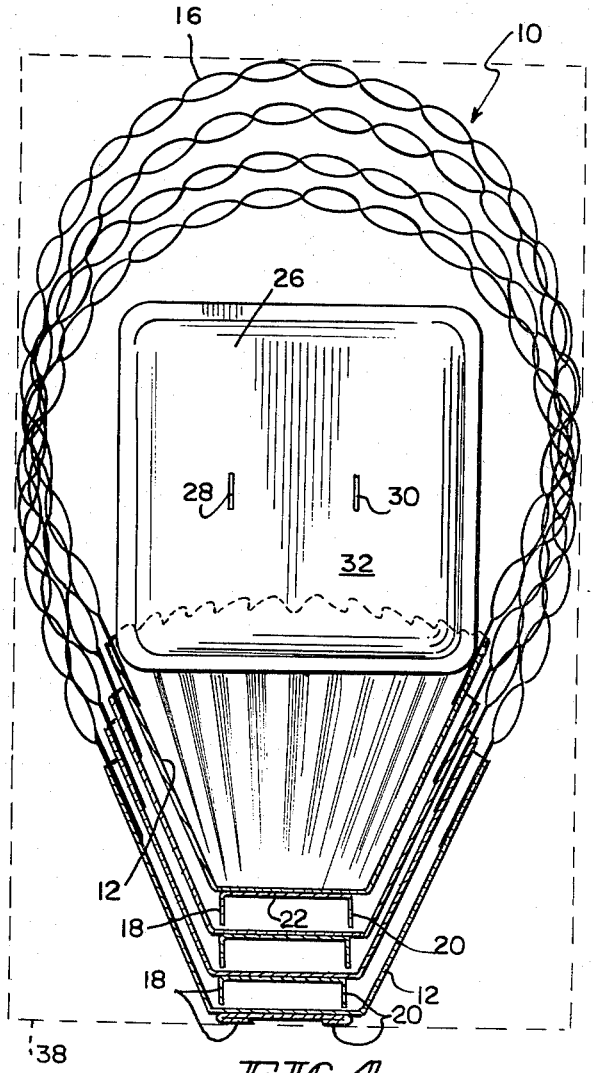
FIG. 4 is a view, partially sectioned, showing a plurality of baskets nested together in the outline of a container and showing how the bases of FIG. 3 may be nested in and shipped with the baskets.
Figure 5:
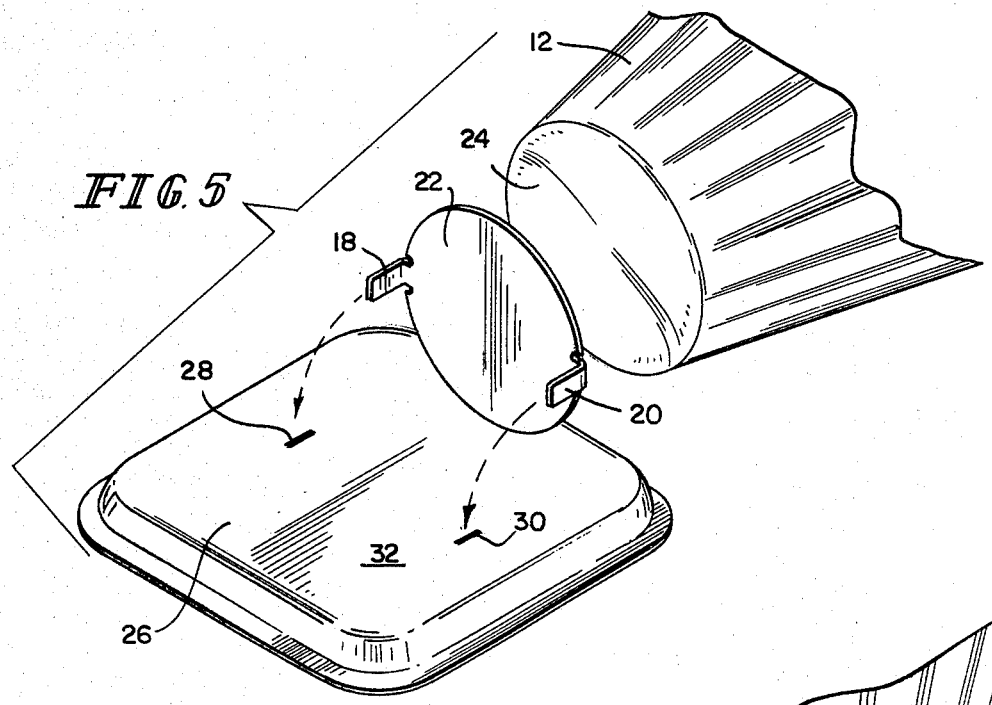
FIG. 5 is a fragmentary exploded perspective view showing how the floral basket may be connected to the FIG. 3 base.

Referring to the drawings, and particularly to FIG. 1, it will be seen that a floral basket 10 is illustrated as having an upwardly opening container 12 generally concentrically mounted upon a base 14. A large loop-type handle 16 is provided for picking up and handling the basket 10. Looking at FIG. 2, it will be seen that tabs 18 and 20 are folded over to engage the downwardly facing surface 21 of the upper portion of the base 14. These tabs 18 and 20 may preferably be provided on a plate 22 as shown in FIG. 5, which in turn may be spot-welded or otherwise securely fastened to the bottom 24 of the container 12. Alternatively, particularly where the container 12 is not required to hold water or some other material which might leak, the tabs may be formed to extend directly from the bottom 24 of the container. The particular base 14 illustrated in FIG. 1 is generally frusto-conically shaped and formed in a manner disclosed in a patent application being filed concurrently herewith. The base 14 is merely illustrative, and, in fact, FIGS. 3 and 4 show a relatively flat rectangular base 26 having slots 28, 30, respectively, for receiving the tabs 18, 20. As best seen perhaps in FIGS. 3 and 6, each base 26 has a generally flat and generally square upper surface 32 and a lower outer perimetral edge portion 34 generally parallel to the upper surface 32 and designed to rest upon the floor or upon a table. For smoothness of appearance, as well as for nesting, the bases 26 are smoothly rounded as indicated at 36 in FIG. 6. A plurality of bases 26, for instance, may be placed in the uppermost container 12 in a plurality of nested baskets 10 where the tabs 18, 20 serve to maintain a space between each container 12 and shipped, for instance, in a container outlined at 38 in FIG. 4. It will be appreciated, however, that the number of baskets to be nested and the manner in which they may be shipped can be varied, depending upon the circumstances involved. In FIG. 4, for instance, the tabs 18 and 20 of the lowermost container 12 are shown prefolded to facilitate packaging.

Figure 6:
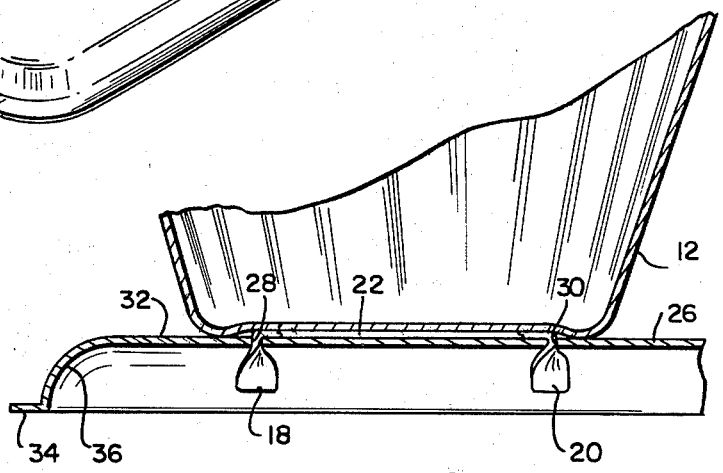
FIG. 6 is a fragmentary sectional view of the connection of FIG. 5.

FIGS. 5 and 6 clearly show how the tabs 18, 20 are inserted through the slots 28, 30 in the base 26, while FIG. 6 shows how the same tabs may be slightly twisted firmly to secure the container 12 to the base.

Figure 7:
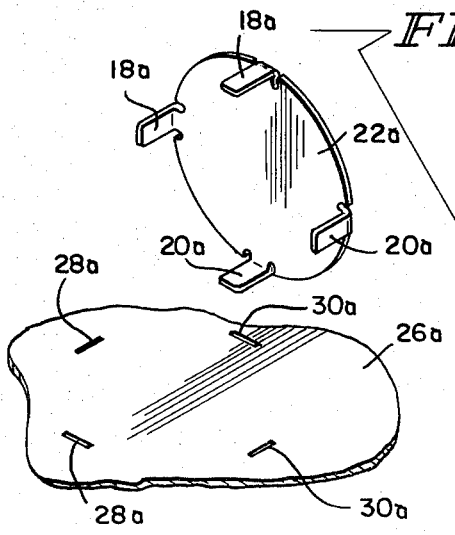
FIG. 7 is a fragmentary view showing a four-tab arrangement.
Figure 8:
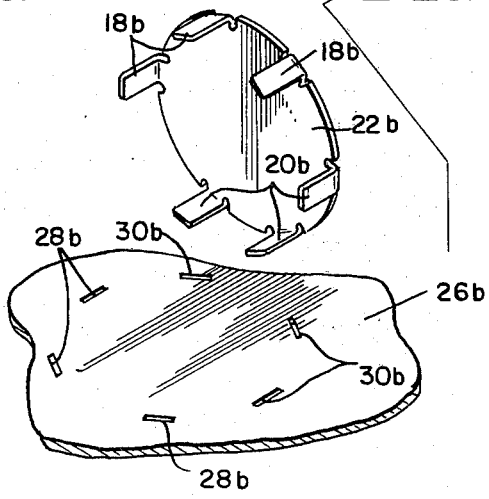
FIG. 8 is a fragmentary view showing a six-tab arrangement.

FIGS. 7 and 8 show, respectively, four and six tab connections.

In the FIG. 7 structure, there are two slots **28*a* for two tabs 18*a* and two slots 30*a* for two tabs 20*a*. The tabs 18*a*, 20*a*, and, of course, the slots 28*a*, 30*a* are separated ninety degrees apart in the FIG. 7 structure. This would tend more securely to fasten the connector plate 22*a* to the base 26*a***.

In the FIG. 8 structure, the connector plate **22*b* has three tabs 18*b* insertable through three slots 28*b* and three tabs 20*b* insertable through slots 30*b*. The slots 28*b*, 30*b* are separated by sixty degree angles in the base 26*b* of the FIG. 8** structure.

It will be appreciated, therefore, that there is disclosed a container and a base for the container, the base having an upwardly facing plate portion upon which the container rests. The plate portion of the base is provided with a plurality of apertures, and the container has a lower portion and means providing, on the lower portion, a plurality of downwardly-extending protrusions insertable downwardly through the apertures. The protrusions are deformable to engage the plate portion and to attach the container and the base.

Further, there is disclosed an upwardly-opening container having a lower portion terminating with a centrally-located generally flat and horizontally extending bottom, and a downwardly-opening base having an upper portion terminating with a centrally-located generally flat and horizontally extending top. Means are provided for connecting the container to the base with the bottom resting on the top. Either the top or the bottom, in accordance with this invention, may be provided with apertures and the other may be provided with protrusions insertable through the apertures. The means connecting the container and base, therefore, include the protrusions which preferably are deformable either by hand or with a pair of pliers.

I claim:

1. An upwardly opening container having a shape adaptable for stacking the container within containers of similar construction which includes a lower portion terminating with a centrally-located generally flat and horizontally extending bottom, a downwardly opening base having a shape adaptable for nesting a plurality of said bases within said container when unattached to said container which includes an upper portion terminating with a centrally-located generally flat and horizontally extending top upon which the container rests and a lower portion having an outer perimetral edge generally parallel to said horizontal top of said upper portion, said upper and lower portions of said base being smoothly rounded for nesting, and means for connecting said container to said base with said bottom resting on said top, said top of said base being provided with apertures and said bottom of said container being provided with downwardly extending protrusions insertable through said apertures, the connecting means including said protrusions, said extending protrusions providing spacers for nesting said container.

2. The container of claim 1 in which said connecting means includes a connection plate securely fastened to said bottom and providing a plurality of downwardly extending tabs comprising said protrusions, said tabs being deformable to securely attach said container and base together.

3. An upwardly opening container having a shape adaptable for stacking the container within containers of similar construction and a base for the container, said base having an upwardly facing plate portion upon which said container rests and a shape adaptable for stacking a plurality of said bases within said container when unattached to said container, said plate portion being provided with a plurality of apertures, said container having a lower portion and means providing, on said lower portion, a plurality of downwardly extending protrusions insertable downwardly through said apertures, said extending protrusions providing spacers for stacking said container, said protrusions being deformable to engage said plate portion to attach said container and said base.

* * * * *